US007469651B2

(12) United States Patent
Sandstrom et al.

(10) Patent No.: US 7,469,651 B2
(45) Date of Patent: Dec. 30, 2008

(54) LNG SLOSHING IMPACT REDUCTION SYSTEM

(75) Inventors: Robert E. Sandstrom, Sugar Land, TX (US); Tin Woo Yung, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 47 days.

(21) Appl. No.: 11/630,356

(22) PCT Filed: Jun. 28, 2005

(86) PCT No.: PCT/US2005/023195

§ 371 (c)(1),
(2), (4) Date: Dec. 21, 2006

(87) PCT Pub. No.: WO2006/014301

PCT Pub. Date: Feb. 9, 2006

(65) Prior Publication Data

US 2007/0245941 A1 Oct. 25, 2007

Related U.S. Application Data

(60) Provisional application No. 60/585,207, filed on Jul. 2, 2004.

(51) Int. Cl.
*B63B 25/08* (2006.01)
*B63B 43/10* (2006.01)

(52) U.S. Cl. ..... 114/74 A; 114/69

(58) Field of Classification Search ..... 114/74 R
See application file for complete search history.

(56) References Cited

U.S. PATENT DOCUMENTS

| | | | | |
|---|---|---|---|---|
| 2,860,809 | A | 11/1958 | Perry | 220/22 |
| 3,092,063 | A | 6/1963 | Leroux | 114/74 |
| 3,166,212 | A | 1/1965 | Resos | 220/23.4 |

(Continued)

FOREIGN PATENT DOCUMENTS

| | | |
|---|---|---|
| FR | 2800349 | 5/2001 |

(Continued)

OTHER PUBLICATIONS

EP Standard Search Report No. RS111770 dated Mar. 29, 2005, 2 pgs.

(Continued)

*Primary Examiner*—Jesus D Sotelo

(57) ABSTRACT

A tank is provided that reduces sloshing pressures in the corner sections of a tank, such as an LNG membrane tank. The tank includes a sloshing impact reduction system placed in selected corner sections within the tank. The system serves as a slosh attenuation system, and reduces the severity of the corner geometry and improves the flow of fluids into the tank corner. In one embodiment, an impermeable structure is disposed in an internal corner section of the tank. The impermeable structure may be a triangular planar surface, or a non-planar structural surface. The non-planar structural surface may be a concave surface or other curved surface. In another arrangement, a permeable structure is placed in an internal corner section of the tank. Such a permeable structure would enable fluid to pass through the device, but would reduce the fluid velocities and accelerations via friction or eddies. The permeable structure may be either rigid or flexible.

27 Claims, 4 Drawing Sheets

U.S. PATENT DOCUMENTS

| | | | | | |
|---|---|---|---|---|---|
| 3,314,567 | A | | 4/1967 | Becker et al. | 220/15 |
| 3,319,431 | A | | 5/1967 | Clarke et al. | 62/45 |
| 3,326,167 | A | | 6/1967 | Paoli | 114/74 |
| 3,414,155 | A | | 12/1968 | Corvino | 220/5 |
| 3,422,782 | A | | 1/1969 | Ripley | 114/125 |
| 3,499,410 | A | | 3/1970 | Field et al. | 114/125 |
| 3,602,003 | A | | 8/1971 | Hampton | 62/54 |
| 3,612,333 | A | | 10/1971 | Cowles | 220/15 |
| 3,678,877 | A | | 7/1972 | Csupor | 114/125 |
| 3,692,205 | A | | 9/1972 | Cowles et al. | 220/9 LG |
| 3,814,275 | A | | 6/1974 | Lemons | 220/9 LG |
| 3,927,788 | A | | 12/1975 | Zinniger et al. | 220/9 LG |
| 3,941,272 | A | | 3/1976 | McLaughlin | 220/9 LG |
| 4,032,608 | A | | 6/1977 | Zinniger et al. | 264/46.6 |
| 4,228,754 | A | * | 10/1980 | Shibata et al. | 114/74 R |
| 4,452,162 | A | | 6/1984 | Harbaugh | 114/74 A |
| 4,459,929 | A | | 7/1984 | Ffooks | 114/74 |
| 4,638,754 | A | | 1/1987 | Tornay | 114/79 |
| 4,789,170 | A | | 12/1988 | Reber | 280/5 |
| 4,863,055 | A | | 9/1989 | Bietz | 220/5 A |
| 5,375,547 | A | | 12/1994 | Abe et al. | 114/74 A |
| 5,727,492 | A | | 3/1998 | Cuneo et al. | 114/74 A |
| 5,778,813 | A | | 7/1998 | Kennedy | 114/74 A |
| 6,220,287 | B1 | | 4/2001 | Wolf | 137/574 |
| 6,283,412 | B1 | | 9/2001 | Mango | 244/135 R |
| 6,971,537 | B2 | | 4/2003 | Enright, Jr. | 220/9.4 |
| 6,595,382 | B2 | | 7/2003 | Ettlinger | 220/560.11 |
| 6,619,502 | B2 | | 9/2003 | Walther et al. | 220/639 |
| 6,626,319 | B2 | | 9/2003 | Miller et al. | 220/560.07 |
| 6,630,249 | B2 | | 10/2003 | Kennedy | 428/625 |
| 6,729,492 | B2 | | 5/2004 | Gulati | 220/560.04 |
| 6,786,166 | B1 | | 9/2004 | Marchand et al. | 114/74 |

FOREIGN PATENT DOCUMENTS

| | | |
|---|---|---|
| GB | 2143783 | 2/1985 |
| JP | 56094095 | 7/1981 |
| WO | WO 95/26482 | 10/1995 |

OTHER PUBLICATIONS

PCT Search & Written Opinion dated Oct. 24, 2005, 5 pgs.

* cited by examiner

LNG SLOSHING IMPACT REDUCTION SYSTEM

CROSS REFERENCE TO RELATED APPLICATIONS

This application is the National Stage of International Application No. PCT/US05/23195, filed Jun. 28, 2005, which claims the benefit of U.S. Provisional Patent Application No. 60/585,207 filed on Jul. 2, 2004.

BACKGROUND

1. Field of the Inventions

Embodiments of the present invention generally relate to the transportation of large fluid volumes in a vessel. More particularly, embodiments of the present invention relate to tank designs for the reduction of loads due to sloshing of contained fluids, such as liquefied natural gas.

2. Description of Related Art

The transportation of liquefied natural gas (or "LNG") through marine bodies is oftentimes accomplished by storing LNG at very low temperatures within membrane tanks. In one form, membrane tanks are prismatic in shape, meaning that that they are shaped to generally follow the contours of the ship's hull. The tank will typically consist of insulating panel membranes joined to the inside of a smooth-walled steel tank hold. The hull provides reinforcement to the membrane tank, thereby strengthening the tank against hydrostatic and dynamic forces generated by the contents.

Membrane containment structures are generally constructed of either stainless steel or Invar. Invar is a high nickel content alloy having minimal thermal expansion characteristics. Both a primary and a secondary containment barrier are typically provided. Insulation panels are then placed between the primary and secondary barriers. The insulation panels are usually made from either blocks of plywood-reinforced polyurethane foam, or stiffened plywood boxes containing perlite as insulation.

It is desirable to increase the size of LNG carriers so that fewer ships are required to transport equivalent volumes of gas. Larger ships allow for larger tanks and larger corresponding containment volumes. However, larger volumes may induce higher "sloshing" loads within the membrane's primary and secondary barriers. This potential exists even at high fill levels.

SUMMARY

A tank design is provided that reduces sloshing forces in the corner sections of a tank. The tank is configured and adapted for holding a cryogenic fluid under conditions such that the tank is subjected to environmental forces which induce motion of the tank. Motion of the tank, in turn, causes sloshing of the liquid therein. Such environmental forces may be marine forces, wind forces, seismic forces, and other environmental forces.

The tank has at least two converging panels, and a tank bulkhead. The two converging panels and the bulkhead together form a corner section of the containment structure. The containment structure further comprises a sloshing impact reduction system for attenuating fluid forces acting on the corner section. The sloshing impact reduction system is positioned inside the tank, and is disposed over at least the corner section. More specifically, the sloshing impact reduction system is disposed over at least one exposed corner section, that is, a corner section that is or can become exposed above the instantaneous liquid level within the containment structure.

In one embodiment, an impermeable surface structure is disposed in an internal corner section of the tank. The impermeable structure may be a triangular or other planar surface, or a non-planar structural surface. The non-planar structural surface may be a concave surface or other curved surface. In any embodiment, the impermeable structure is configured to attach to a fore- or aft-bulkhead corner in an exposed corner section. The impermeable surface structure may be either rigid or deformable.

In another arrangement, a permeable structure is placed in an internal corner section of the tank. Such a permeable structure would be semi-transparent to liquid sloshing, that is, the structure would enable liquid such as LNG to pass through the device, but would reduce the fluid velocities and accelerations via friction, diffraction, or cavitation. Examples of rigid permeable structures include grates, a perforated plate, and a series of bars or tubes configured across an exposed tank corner. The permeable surface structure may be either rigid or flexible.

In another arrangement, a dynamic structure is placed in an internal corner section of the tank. Such a dynamic surface structure redirects fluid forces away from the exposed corner section. An example of a dynamic structure is a responsive hydrofoil.

A sloshing impact reduction system is also provided. The sloshing impact reduction system may be rigid, permeable or deformable. The sloshing impact reduction system is configured to cover at least a part of an exposed corner section of an LNG tank, as described above. In one arrangement, the LNG tank is on a floating vessel.

BRIEF DESCRIPTION OF THE DRAWINGS

In FIG. 2, two selected illustrative corner sections of the membrane tank are more clearly seen.

In FIG. 4A, the system provides a substantially planar surface. In FIG. 4B, the system is a non-planar surface. The illustrative non-planar surface is concave.

In FIG. 5A, the structure includes a series of tubes or bars. In FIG. 5B, the structural surface is a grate arrangement comprising either tubes or bars. Finally, in FIG. 5C, a perforated plate is shown as the structural surface.

DETAILED DESCRIPTION

Definitions

Figure 1:
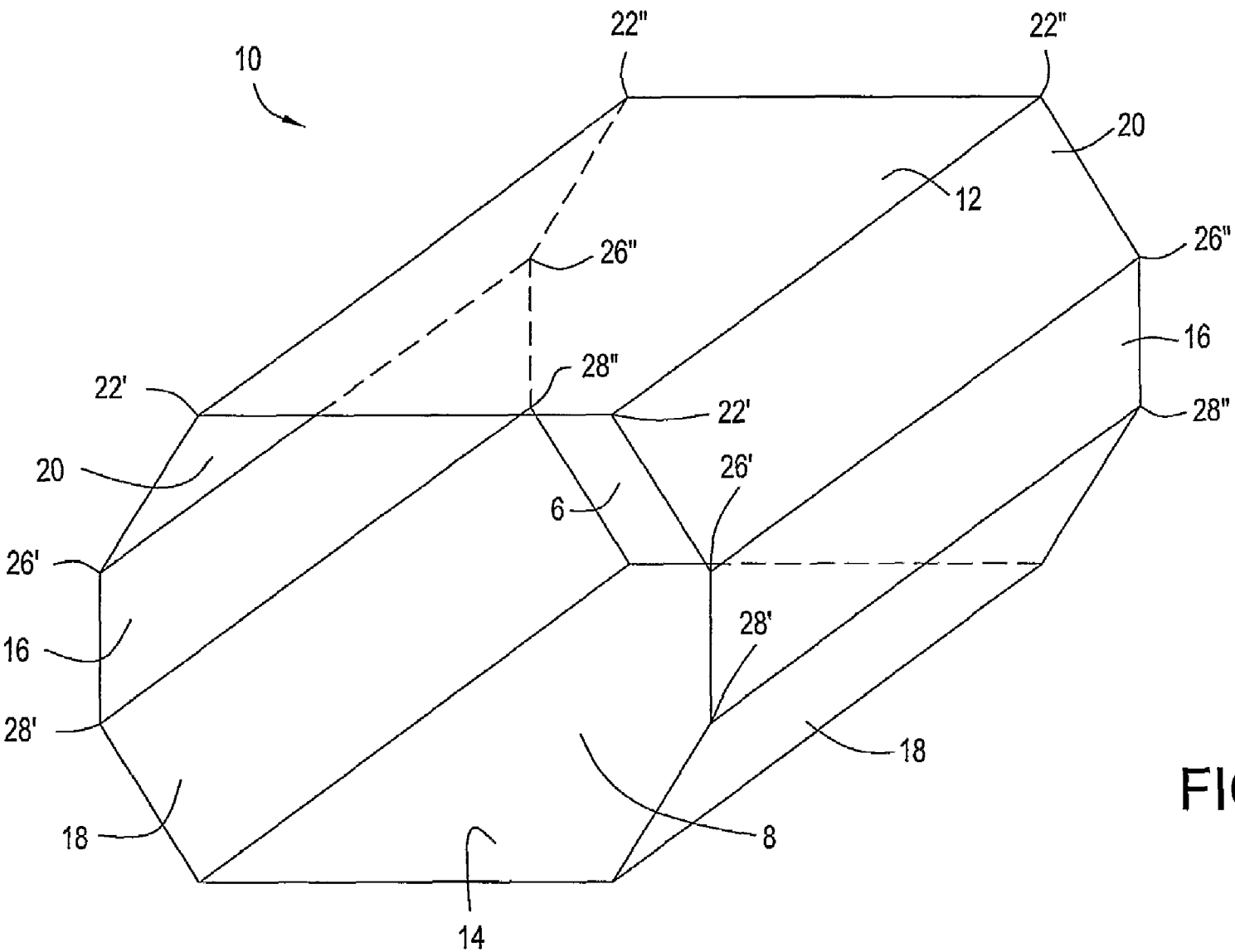
FIG. 1 presents a perspective view of a containment structure. In the illustrative drawing of FIG. 1, the containment structure represents a prismatic membrane tank.

The following words and phrases are specifically defined for purposes of the descriptions and claims herein. To the extent that a term has not been defined, it should be given its broadest definition that persons in the pertinent art have given that term as reflected in printed publications, dictionaries and/or issued patents.

"Membrane tank" means a tank that is at least partially supported by or otherwise relies upon a surrounding vessel hull structure to maintain its shape and integrity and to absorb hydrostatic forces imposed by the contents.

"Prismatic tank" means a three-dimensional tank having at least a top panel, a bottom panel, and two opposing vertical end panels known as "bulkheads." Such a tank may be generally shaped to follow the contours of a ship's hull. In some instances, a "prismatic tank" may be a "half of a prismatic tank." This means that a prismatic tank has been bisected generally along its major axis so that two half-prismatic tanks may be placed on the ship's hull, side-by-side.

"Vertical panel" means a side panel of a tank that is substantially vertical. Such side panel need not be at a 90 degree angle to the plane of the vessel on which the tank rests, but may be inclined inwardly or outwardly. In this way, the footprint of the top panel and bottom panel need not be of equal size.

"End panel" means any substantially vertical panel at an end of a tank. Such end panels need not be at a 90 degree angle to the plane of the vessel on which the tank rests, but may be inclined inwardly or outwardly. In this document "Bulkhead" is another term for "end panel." "Fore bulkhead" refers to the panel closest to the forward end of the vessel, while "aft bulkhead" refers to the panel closest to the rearward end of the vessel. While it is typically understood in ship terminology that bulkhead is considered to be any vertical planar surface, as used herein, the term is limited to one of the vertical end panels.

"Chamfer panel" means any substantially planar panel disposed between a vertical panel and either a top panel or a bottom panel.

"Upper chamfer" refers to any chamfer panel that is disposed between a vertical side panel and a top panel.

"Corner section" means any corner defined by the intersection of two converging panels at either the fore- or aft-bulkhead. Examples of corner sections include (1) an intersection of a top panel and a vertical side panel of a tank, at either the fore- or aft-bulkhead; (2) an intersection of a top panel and an upper chamfer panel, either at the fore- or aft-bulkhead; and (3) an intersection of a vertical panel and an upper chamfer panel, at either the fore- or aft-bulkhead.

"Exposed corner section" means any corner section that can be exposed above the fluid within the containment structure, where the fluid is stationary or in motion.

"Sloshing impact reduction system" means any structure placed in a corner section of a membrane tank for reducing pressures caused by sloshing of liquid therein. The sloshing impact reduction system may also be referred to as an "impact reduction surface structure." The impact reduction system is not intended to provide any appreciable structural support to the tank.

DESCRIPTION OF SPECIFIC EMBODIMENTS

The following provides a description of specific embodiments of the present invention:

A tank is provided for holding a cryogenic liquid. The tank holds the liquid under conditions such that the tank is subjected to environmental forces which induce motion of the tank and, in turn, sloshing of the liquid in the tank. The tank includes, in one aspect, at least two converging panels and a tank bulkhead defining an exposed corner section of the tank. In addition, the tank includes a slosh impact reduction system for attenuating fluid forces acting on the exposed corner section of the tank during sloshing. The slosh impact reduction system is positioned inside the tank and configured to cover at least the corner section. In one arrangement, the tank is a membrane tank, and the cryogenic fluid is liquefied natural gas.

In one aspect, the tank is disposed within a floating vessel, and the environmental forces are wind and wave forces. In another embodiment, the tank is land-based and is subject to seismic forces.

The sloshing impact reduction system may take a number of different forms. In one embodiment, it defines a rigid structural surface. The rigid structural surface may be a substantially planar structural surface. The substantially planar structural surface may be, for example triangular. The rigid structural surface may be either permeable or impermeable. Nonlimiting examples of a rigid and permeable structural surface include grates, a series of bars, a series of tubes, and a perforated plate. Nonlimiting examples of a flexible and permeable structural surface include a flexible perforated plate, a series of flexible bars, and a series of flexible tubes. Alternatively, the sloshing impact reduction system may be dynamic for redirecting fluid forces being directed at the corner section.

A sloshing impact reduction system for a membrane tank is also provided. The membrane tank is adapted for transporting liquefied natural gas under conditions such that the membrane tank is subjected to wind and wave forces which cause sloshing of the liquefied natural gas in the membrane tank. The sloshing impact reduction system may be as described above. In one embodiment, the exposed corner section is selected from intersections within the membrane tank consisting of:

a) an intersection of a top panel and a vertical side panel of the membrane tank at the fore-bulkhead;

b) an intersection of a top panel and a vertical side panel of the membrane tank at the aft-bulkhead;

c) an intersection of a top panel and an upper chamfer panel at the fore-bulkhead;

d) an intersection of a top panel and an upper chamfer panel at the aft-bulkhead;

e) an intersection of a vertical panel and an upper chamfer panel at the fore-bulkhead;

f) an intersection of a vertical panel and an upper chamfer panel at the aft-bulkhead; and g) any combination of the above.

Description of Embodiments Shown in the Drawings

The following provides a description of specific embodiments shown in the drawings:

In tanks that are subject to environmental forces such as wind and wave, the volumes of fluid held therein may "slosh." For tanks that hold large fluid volumes, such larger volumes may induce higher sloshing loads. For tanks that are configured to hold cryogenic fluids, such as membrane tanks, such tanks may be more sensitive to sloshing loads. This sensitivity can exist even at high fill levels. Under normal ocean transit conditions, the highest loads as determined in model tests have been concentrated in the upper corners of the membrane tank. The corners occur where a transverse bulkhead intersects either an upper chamfer or a top panel of the tank. It is anticipated that similar results would prevail for a land-based tank that is subjected to sloshing loads due to other environmental forces, such as seismic activity.

FIG. 1 presents a perspective view of an illustrative containment structure 10 for utilizing a sloshing impact reduction system (shown in subsequent figures). The illustrative containment structure 10 of FIG. 1, represents a membrane tank. The membrane tank 10 includes various panels. These include a top panel 12, a bottom panel 14, and opposing end panels 8, 6. End panel 8 is intended to represent a fore-bulkhead, while end panel 6 is intended to represent an aft-bulkhead. The illustrative containment structure, or "tank" 10 further includes opposing vertical panels 16, and intermediate upper 20 and lower 18 chamfer panels.

Various corner sections are defined between the top panel 12 and the opposing side panels 16, or "vertical panels." In the particular tank arrangement 10 of FIG. 1, upper 20 and lower 18 chamfer panels are employed between the top panel 12 and the opposing side panels 16, creating additional corner sections, as follows:

Two corner sections are created at the intersection of the top panel 12 and the upper chamfer panels 20, at the fore-bulkhead 8. These are shown by reference number 22'.

Two corner sections are created at the intersection of the top panel 12 and the upper chamfer panels 20, at the aft-bulkhead 6. These are shown by reference number 22".

Two corner sections are created at the intersection of the side panels 16 and the upper chamfer panels 20, at the fore-bulkhead 8. These are shown by reference number 26'.

Two corner sections are created at the intersection of the side panels 16 and the upper chamfer panels 20, at the aft-bulkhead 6. These are shown by reference number 26".

Two corner sections are created at the intersection of the side panels 16 and the lower chamfer panels 18, at the fore-bulkhead 8. These are shown by reference number 28'.

Two corner sections are created at the intersection of the side panels 16 and the lower chamfer panels 18, at the aft-bulkhead 6. These are shown by reference number 28".

When liquid is placed within the containment structure 10, certain of the corner sections 22', 22", 26', 26", 28', 28" are subject to fluid forces during "sloshing." Sloshing occurs when the containment structure 10 is subjected to environmental forces. Where the containment structure 10 is on land, in a bottom founded ocean structure, or in a dry dock, such environmental forces may be seismic forces. Where the containment structure 10 is on a floating vessel located on a body of water, such as in the ocean, such forces may include waves and wind. The corner sections that experience sloshing are a function of the volume of fluid within the structure 10. More specifically, it is the "exposed corner sections," i.e., those corners that are above the fluid line at any given moment that will experience dynamic fluid forces from sloshing. Typically (but not always), only the uppermost corner sections, i.e., 22' and 22", will be "exposed" corner sections.

Figure 2:
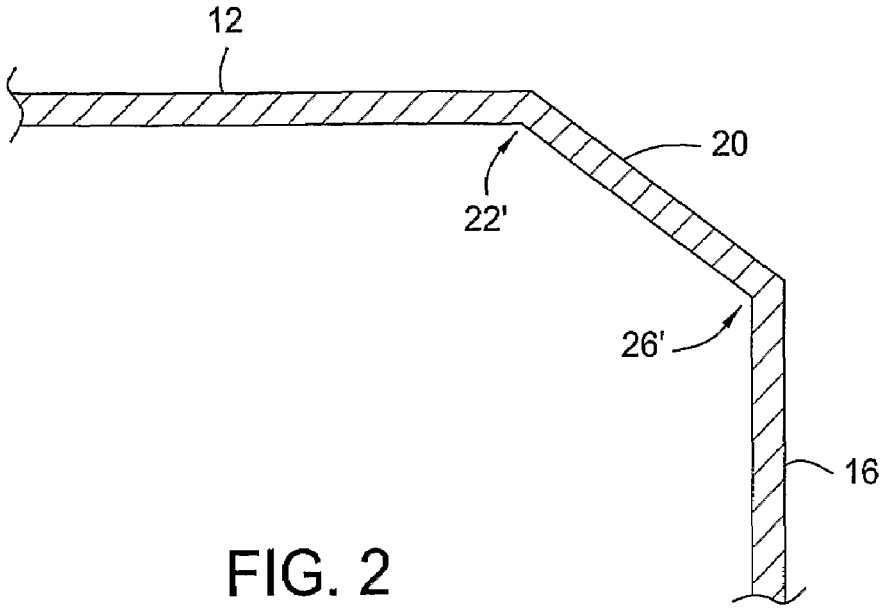
FIG. 2 is an enlarged cross-sectional view of a portion of the containment structure of FIG. 1.

FIG. 2 is an enlarged cross-sectional view of a portion of the containment structure 10 of FIG. 1. In FIG. 2, selected corner sections 22' and 26' of the membrane tank 10 are more clearly seen. Corner section 22' is placed at the intersection of the top panel, the upper chamfer panel 20, and the fore-bulkhead (not shown). Corner section 26' is seen at the intersection of the top panel, the upper chamfer panel 20, and the fore-bulkhead (not shown).

It is understood that the corner sections 22', 22", 26', 26", 28', 28" shown in FIGS. 1 and 2 are for illustrative purposes. The sloshing impact reduction systems disclosed herein are not limited in utility to the particular corner section arrangements that may be employed in a membrane tank, or even to the type of containment structure used. Thus, the containment structure may be a land-based or a vessel-based structure.

Various sloshing impact reduction systems are provided herein for reducing the severity of the geometry of the various corner sections 22', 22", 26', 26", 28', 28". Depending on the configuration, the systems may also improve the flow of fluids in the vicinity of the tank corners, reducing sloshing impact pressures. Such corner systems may be utilized in any or all of the above corner sections 22', 22", 26', 26", 28', 28". Such corner designs may be referred to herein as either "sloshing impact reduction systems, or as "sloshing reduction surface structures." The "sloshing reduction surface structures" are not shown in FIG. 1 or FIG. 2. However, various embodiments are described below, and are shown in connection with FIGS. 3, 4A-4B, 5A-5C and 6.

Figure 3:
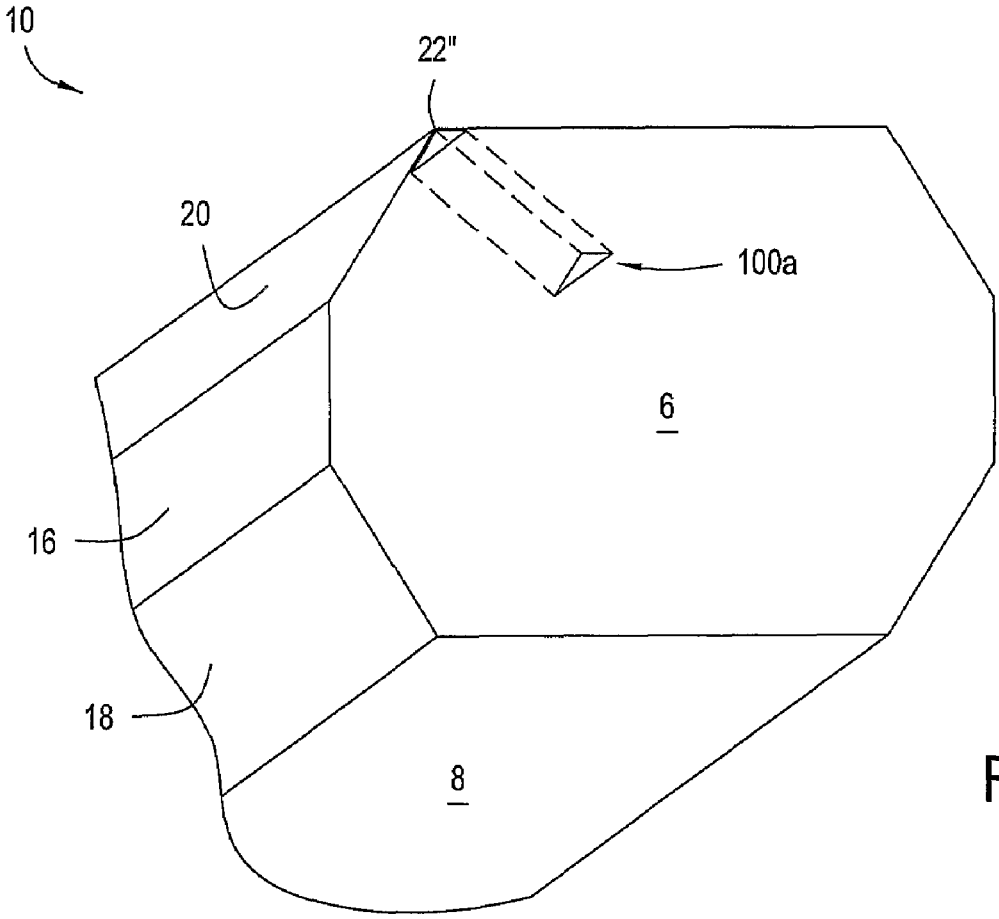
FIG. 3 shows a cutaway view of the membrane tank of FIG. 1, along with a sloshing impact reduction system, in one embodiment. The system is exploded away from an illustrative exposed corner section. The top panel has been removed from FIG. 3 for clarity.

Referring first to FIG. 3, this figure shows a cutaway view of the membrane tank 10 of FIG. 1. In addition, a sloshing reduction structural surface 100*a*, in one embodiment, is shown. The structural surface 100*a* is disposed in the corner section 22", but is exploded away from the corner section 22" for illustrative purposes. The top panel of the containment structure 10 has been removed for clarity.

The particular sloshing reduction structural surface 100*a* shown in FIG. 3 is an impermeable and substantially planar structure. The illustrative structural surface 100*a* defines a triangular configuration. The triangular configuration is preferred for the impermeable embodiment, as it allows for a seamless fit into a corner section of the interior of a membrane tank 10. The substantially planar structure 100*a* may be rigid. For example, and not by way of limitation, the structure 100*a* may be fabricated from a metal. Alternatively, the structure 100*a* may be deformable. For example, and not by way of limitation, the structure 100*a* may be fabricated from an elastomeric material, or may be gel-filled.

Figure 4A:
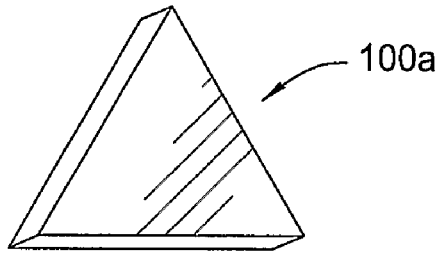
FIGS. 4A-4B provide perspective views of impermeable sloshing impact reduction systems, in alternate embodiments.
Figure 4B:
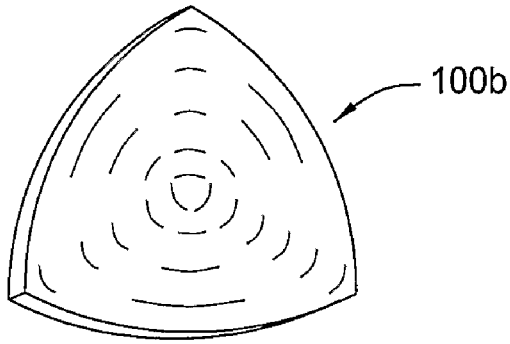

FIGS. 4A-4B provide enlarged perspective views of impermeable sloshing impact reduction systems, in two embodiments. FIG. 4A provides an enlarged view of the structural surface 100*a* of FIG. 3. The structural surface 100*a*, again, is a substantially planar surface, and serves as an impermeable plate. FIG. 4B provides an example of an impermeable and non-planar structural surface 100*b*. The non-planar structural surface may be a concave surface or other curved surface. A concave embodiment is shown in FIG. 4B. The concave structure 100*b* is likewise configured to attach to a fore-or aft-bulkhead corner, e.g., corner 22'.

Figure 5A:
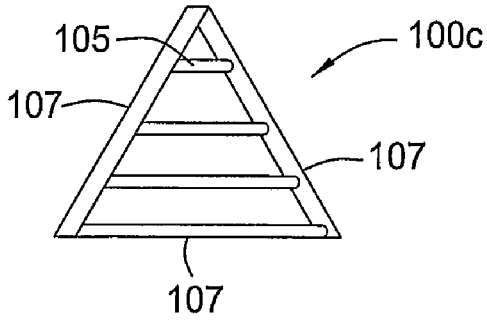
FIGS. 5A-5C present perspective views of yet additional sloshing impact reduction systems. The systems of FIGS. 5A-5C represent permeable structures.

In other arrangements, a permeable structure may be placed in an internal corner section of a tank 10. Such a permeable structure is semi-transparent to liquid sloshing, that is, the structure enables liquid such as LNG to pass through the device, but at the same time reduces the fluid velocities and accelerations via friction, diffraction, or cavitation. FIG. 5A provides one example of a rigid and permeable sloshing impact reduction system 100*c*. In this arrangement, a triangular configuration is again provided. The structure 100*c* is defined by three outer frame members 107, and various internal members 105. The outer frame members 107 and the internal structural members 105 may be solid bars or may be hollow tubes. They may be rigid, or may be flexible. Preferably, the members 107, 105 are fabricated from a metal alloy.

Figure 5B:
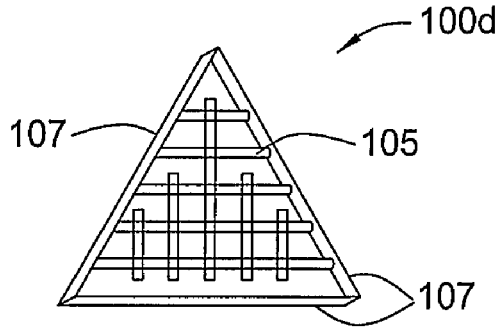

FIG. 5B provides another arrangement for a permeable surface structure 100*d*. In this arrangement, the surface structure 100*d* defines a grate. As with the surface structure 100*c* of FIG. 5A, the structure 100*d* of FIG. 5B may be made of external 107 and internal 105 members that are tubes or bars or a combination thereof. Again, this permeable structure arrangement 100*d* may be either rigid or flexible.

Figure 5C:
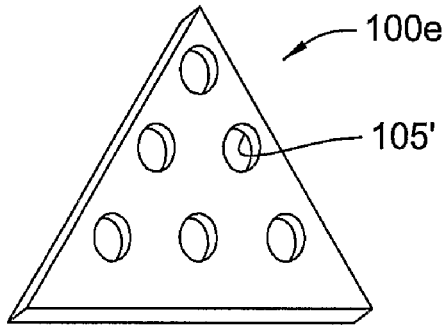

FIG. 5C shows a third possible embodiment for a permeable sloshing impact reduction system 100*e*. Here, the system 100*e* defines a perforated plate. The plate 100*e* has a plurality of through-openings 105' therein.

Figure 6:
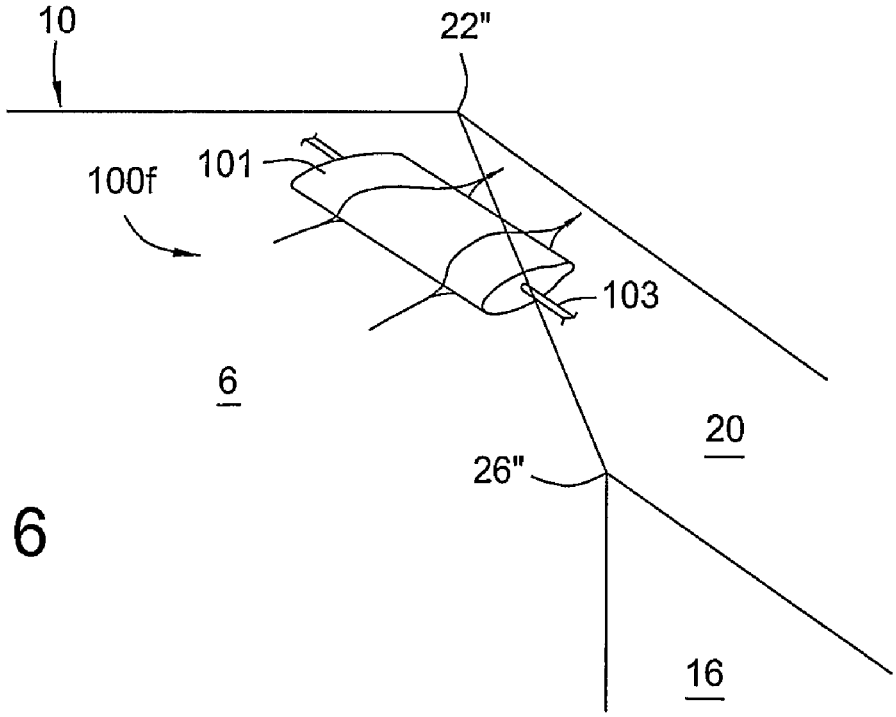
FIG. 6 provides a perspective view of a sloshing impact reduction system, in an additional alternate embodiment. This is a dynamic system.

FIG. 6 provides a perspective view of a sloshing reduction surface structure, in an additional alternate embodiment. This is a dynamic structure. In this respect, the structure redirects fluid forces away from the exposed corner section. In FIG. 6, the illustrative structure 100*f* is a hydrofoil, though other dynamic surfaces may be contemplated. The hydrofoil 100*f* is shown in an exposed corner section 22" of a containment structure 10. The top panel has been removed from the tank for clarity. The hydrofoil 100*f* pivots about hinges 103 in response to hydraulic forces.

A description of certain embodiments of the inventions has been presented above. However, the scope of the inventions is defined by the claims that follow. Each of the appended claims defines a separate invention, which for infringement purposes is recognized as including equivalents to the various elements or limitations specified in the claims.

What is claimed is:

1. A tank for holding a cryogenic liquid under conditions such that the tank is subjected to environmental forces which induce motion of the tank and, in turn, sloshing of the liquid in the tank, comprising:

at least two converging panels and a tank bulkhead defining an exposed corner section of the tank, wherein the exposed corner section is selected from intersections within the tank consisting of:

a) an intersection of a top panel and a vertical side panel of the tank at the fore-bulkhead;

b) an intersection of a top panel and a vertical side panel of the tank at the aft-bulkhead;

c) an intersection of a top panel and an upper chamfer panel at the fore bulkhead;

d) an intersection of a top panel and an upper chamfer panel at the aft bulkhead;

e) an intersection of a vertical panel and an upper chamfer panel at the fore bulkhead;

f) an intersection of a vertical panel and an upper chamfer panel at the aft bulkhead; and g) any combination of a) through f) above; and a slosh impact reduction system for attenuating fluid forces acting on the exposed corner section of the tank during sloshing, said slosh impact reduction system being positioned inside the tank, configured to cover at least the exposed corner section, and wherein the slosh impact reduction system is fitted to the at least two converging panels and the tank bulkhead defining the exposed corner section of the tank.

2. The containment structure of claim 1, wherein the cryogenic liquid is liquefied natural gas.

3. The containment structure of claim 2, wherein the tank is an LNG membrane tank.

4. The tank of claim 1, wherein the slashing impact reduction system defines a rigid structural surface.

5. The tank of claim 1, wherein the slashing impact redaction system defines a rigid and substantially planar structural surface.

6. The tank of claim 5, wherein the substantially planar surface is triangular in configuration.

7. The tank of claim 1, wherein the slashing impact reduction system defines a rigid and impermeable structural surface.

8. The tank of claim 1, wherein the slashing impact reduction system defines a rigid and permeable structural surface.

9. The tank system of claim 1, wherein the slashing impact reduction system defines a rigid and permeable structural surface selected from the group consisting of grates, a series of bars, a series of tubes, and a perforated plate.

10. The tank system of claim 1, wherein the sloshing impact reduction system defines a flexible and permeable structural surface selected from the group consisting of a flexible perforated plate, a series of flexible bars, and a series of flexible tubes.

11. The tank of claim 1, wherein the sloshing impact reduction system defines a deformable structural surface.

12. The tank of claim 1, wherein the sloshing impact reduction system defines a dynamic object for redirecting fluid forces being directed at the corner section.

13. The tank of claim 1, wherein:

the tank is disposed within a floating vessel; and the environmental forces are wind and wave forces.

14. The tank of claim 1, wherein the environmental forces are seismic forces.

15. A sloshing impact reduction system for a membrane tank, the membrane tank being adapted for transporting liquefied natural gas under conditions such that the membrane tank is subjected to wind and wave forces which cause sloshing of the liquefied natural gas in the membrane tank, comprising:

at least two converging panels and a tank bulkhead forming an exposed corner section of the membrane tank, wherein the exposed corner section is selected from intersections within the membrane tank consisting of:

a) an intersection of a top panel and a vertical side panel of the membrane tank at the fore-bulkhead;

b) an intersection of a top panel and a vertical side panel of the membrane tank at the aft-bulkhead;

c) an intersection of a top panel and an upper chamfer panel at the fore bulkhead;

d) an intersection of a top panel and an upper chamfer panel at the aft bulkhead;

e) an intersection of a vertical panel and an upper chamfer panel at the fore bulkhead;

f) an intersection of a vertical panel and an upper chamfer panel at the aft bulkhead; and g) any combination of the above; and a structural surface configured to be placed in the exposed corner section of the membrane tank so as to impede fluid forces acting on the corner section when the liquefied natural gas sloshes into the corner section and wherein the slosh impact reduction system is fitted to the at least two converging panels and the rank bulkhead defining the exposed corner section of the tank.

16. The sloshing impact reduction system of claim 15, wherein the structural surface defines a rigid structural surface.

17. The sloshing impact reduction system of claim 16, wherein the rigid structural surface is substantially planar.

18. The sloshing impact reduction system of claim 17, wherein the substantially planar surface is triangular in configuration.

19. The sloshing impact reduction system of claim 15, wherein the structural surface defines a rigid and impermeable structural surface.

20. The sloshing impact reduction system of claim 15, wherein the structural surface defines a rigid and permeable structural surface.

21. The sloshing impact reduction system of claim 20, wherein the structural surface defines a rigid and permeable structural surface selected from the group consisting of grates, a series of bars, a series of tubes, and a perforated plate.

22. The containment structure system of claim 15, wherein the structural surface defines a flexible and permeable structural surface selected from the group consisting of a flexible perforated plate, a series of flexible bars, and a series of flexible tubes.

23. The containment structure system of claim 15, wherein the structural surface defines a deformable structural surface.

24. The containment structure system of claim 15, wherein the structural surface defines a dynamic object for redirecting fluid forces being directed at the exposed corner section.

25. The sloshing impact reduction system of claim 15, wherein the structural surface extends from a first intersection, to a second adjacent intersection of the membrane tank.

26. The sloshing impact reduction system of claim 15, wherein the exposed corner section is located adjacent a top panel of the membrane tank.

27. The sloshing impact reduction system of claim 15, wherein the membrane tank is disposed within a floating vessel.

* * * * *